United States Patent [19]

Kirby

[11] 4,146,866

[45] Mar. 27, 1979

[54] VARIABLE RESISTANCE CONTROL

[75] Inventor: Joseph L. Kirby, Frankfort, Ind.

[73] Assignee: P. R. Mallory & Co. Inc., Indianapolis, Ind.

[21] Appl. No.: 851,119

[22] Filed: Nov. 14, 1977

[51] Int. Cl.[2] ..... H01C 10/34

[52] U.S. Cl. ..... 338/174; 338/197; 338/308; 338/315

[58] Field of Search ..... 338/174, 160, 162, 188, 338/190, 197, 307, 308, 314, 334; 29/610; 427/101-103

[56] References Cited

U.S. PATENT DOCUMENTS

| | | | |
|---|---|---|---|
| 3,165,714 | 1/1965 | Dreyfus | 338/314 X |
| 3,354,418 | 11/1967 | Casey et al. | 338/163 X |
| 3,381,255 | 4/1968 | Youmans | 338/308 |
| 3,469,225 | 9/1969 | Wood | 338/163 |
| 3,636,493 | 1/1972 | Caddock | 338/314 X |

*Primary Examiner*—C. L. Albritton

*Attorney, Agent, or Firm*—Hoffmann, Meyer & Coles

[57] ABSTRACT

An epoxy glass fabric strip is used to carry a carbon based resistive path.

5 Claims, 2 Drawing Figures

VARIABLE RESISTANCE CONTROL

BACKGROUND OF THE INVENTION

Generally speaking, the present invention relates to an improved variable resistance control wherein an electrical resistance path and an electrical conductive strip are carried on a base and wherein movable electrical contact means electrically bridge the resistance path and the electrical conductive strip, the improvement comprising providing a backing means for the resistance path and connecting the same to the base, the backing means characterized by substantially eliminating humidity drift of the resistance path.

Variable resistance controls are used in appliances such as televisions and stereos to vary their sound output. Such devices in general include resistance a path and an electrical conductive or collector strip carried on a base with a movable contact means bridging the resistance path and collector strip and connected to a knob so as to be rotated about the resistance path and collector strip to vary the output resistance of the device. One of the problems that has been found to be associated with such a device is that the value of the resistance will vary as the humidity of its environment varies.

FEATURES OF THE INVENTION

It is therefore a feature of the present invention to provide a variable resistance control having a means to substantially eliminate a change in its resistance value due to humidity drift. Another feature of the invention is to provide such a device wherein a backing means is applied to a resistor path, the backing means characterized by substantially eliminating humidity drift. Another feature of the invention is the provision of such a control wherein the backing means includes an epoxy glass fabric strip. Still another feature of the invention is the provision of such a control wherein the resistance path comprises a carbon based paint applied to the epoxy glass fabric strip. These and other features of the invention will become apparent from the following description taken in conjunction with the accompanying drawings.

Figure 1:
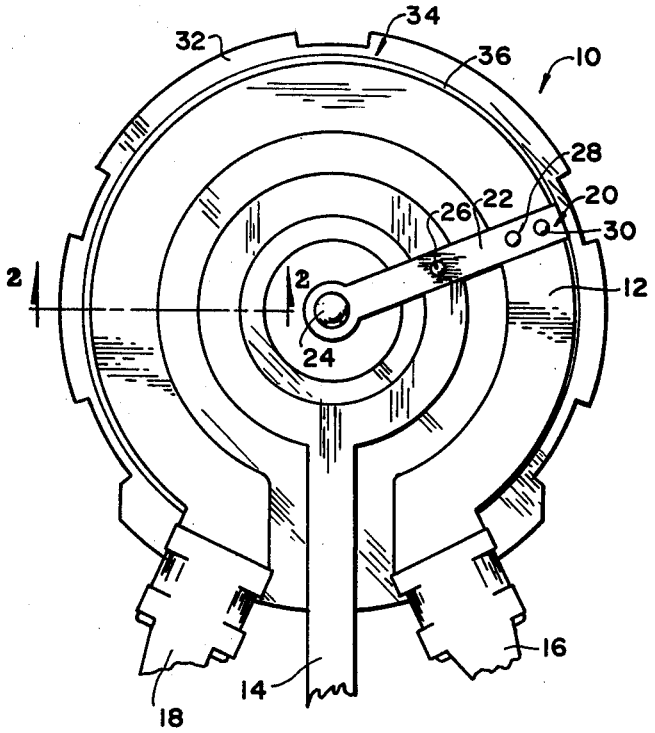
FIG. 1 is a plan view of a variable resistor showing the features of the invention.

Referring to the drawings there is shown a variable resistor control 10 which in general includes a resistance path 12, a collector path 14, electrical terminals 16 and 18 connected to the resistance path, and an electrical contact means 20 electrically bridging the resistance path and the collector strip. Electrical contact means 20 includes an arm 22, connected to a rotatable shaft 24, the arm having an electrical contact 26 engaging collector strip 14 and electrical contacts 28 and 30 engaging resistance path 12. The resistance path and the collector strip are connected to a suitable base 32 by some suitable means such as staking the elements to the base. Thus far what has been described is well known in the art and thus is not described in detail. The whole unit would be carried in a housing, with electrical terminals 16 and 18 (including one for the collector strip) extending outside the housing.

Figure 2:
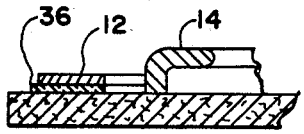
FIG. 2 is a section taken along the line 2—2 of FIG. 1.

As noted previously variable resistors of the type just described have a tendency to vary in its rated resistance due to humidity drift because of the changes in humidity in the environment in which the device is being used. According to the present invention such change in resistance value is substantially eliminated by providing an improved backing means 34 for resistance path 12. Referring to both FIGS. 1 and 2, backing means 34 includes an epoxy glass fabric strip 36 to which the resistive path 12 is applied. The resistive path may be applied to the strip by some suitable means; for example if the resistance path is of carbon, a carbon base paint may be sprayed on to the strip.

Prior to the present invention the resistive path was applied on a phenolic resin. Such variable resistors were found to have a very high resistance change due to humidity. The following tables present comparative data showing the difference and the vast improvement achieved by the present invention over such phenolic constructions:

The data for the tables was acquired by spraying a carbon base paint in one case onto a phenolic strip and, in another case, an epoxy glass fiber strip of the present invention. The resistance paths were both rated at 11 meg ohms ±10%. Both assemblies were preconditioned at 50° C. for 48 hours and then their resistance was measured. Both assemblies were then maintained at a relative humidity of 96% at 40° C. for 72 hours. The resistance was then measured again.

| PHENOLIC STRIP | | | |
|---|---|---|---|
| Test No. | Init. Res. MEG OHMS | Res. After Humidity | % Change |
| 1 | 9.926 | 11.999 | 20.88 |
| 2 | 9.426 | 11.307 | 19.95 |
| 3 | 9.355 | 11.558 | 23.54 |
| 4 | 8.911 | 10.872 | 22.00 |
| 5 | 8.725 | 10.854 | 24.40 |
| 6 | 9.726 | 12.760 | 27.08 |
| 7 | 9.311 | 11.657 | 25.19 |
| 8 | 10.065 | 12.889 | 28.03 |
| 9 | 9.424 | 11.707 | 24.22 |
| 10 | 9.079 | 11.132 | 22.61 |
| 11 | 8.588 | 10.760 | 25.29 |
| 12 | 8.370 | 10.324 | 23.24 |

| EPOXY GLASS FABRIC STRIP | | | |
|---|---|---|---|
| Test No. | Init. Res. MEG OHMS | Res. After Humidity | % Change |
| 1 | 11.513 | 12.014 | 4.35 |
| 2 | 11.199 | 11.702 | 4.49 |
| 3 | 11.600 | 12.200 | 5.17 |
| 4 | 11.514 | 12.141 | 5.44 |
| 5 | 11.420 | 11.963 | 4.75 |
| 6 | 11.062 | 11.743 | 3.28 |
| 7 | 11.369 | 12.026 | 5.77 |
| 8 | 11.640 | 12.270 | 5.41 |
| 9 | 10.828 | 11.360 | 4.91 |
| 10 | 11.780 | 12.252 | 4.06 |
| 11 | 11.679 | 12.155 | 4.07 |
| 12 | 11.116 | 11.595 | 4.30 |

The charts clearly show that there is substantially less change in resistance due to humidity drift in the epoxy glass fiber material.

What is claimed is:

1. In a variable resistance control wherein an electrical resistance path and an electrical conductive strip are carried on a base and wherein movable electrical contact means electrically bridge the resistance path and the electrical conductive strip, the improvement comprising:

(a) providing a backing means for said resistance path and connecting same to said base, said backing means including an epoxy glass strip characterized by having a high resistance to humidity changes so as to substantially eliminate humidity drift of a resistance value of said resistance path.

2. In a variable control according to claim 1 wherein said resistance path comprises a carbon based paint applied to said epoxy glass fabric strip.

3. A method of reducing resistance value drift due to humidity in a variable resistance control wherein a resistance path and an electrical conductive strip are carried on a base and a movable electrical contact means bridges same, comprising (a) providing a backing means for said resistance path including an epoxy glass strip and high resistance to humidity so as to substantially eliminate said resistance value drift, and (b) connecting said backing means to said base.

4. A method according to claim 3 wherein said resistance path comprises a carbon based paint applied to said epoxy glass fabric strip.

5. A method according to claim 4 wherein said carbon paint is sprayed onto said epoxy glass fabric strip.

* * * * *